US008109417B2

(12) United States Patent
Phan

(10) Patent No.: US 8,109,417 B2
(45) Date of Patent: Feb. 7, 2012

(54) GARMENT WASHING DEVICE WITH REMOVABLE FORM

(76) Inventor: Kieu Thi-Bich Phan, Austin, TX (US)

( * ) Notice: Subject to any disclaimer, the term of this patent is extended or adjusted under 35 U.S.C. 154(b) by 1108 days.

(21) Appl. No.: 11/858,514

(22) Filed: Sep. 20, 2007

(65) Prior Publication Data

US 2009/0078725 A1 Mar. 26, 2009

(51) Int. Cl.
*D03C 15/00* (2006.01)

(52) U.S. Cl. ..... 223/84

(58) Field of Classification Search ..... 223/84, 223/57, 66, 1; 450/41–55; 206/278, 292–294, 206/288–289; 248/275; 269/237, 287, 901, 269/254 CS; 99/323
See application file for complete search history.

(56) References Cited

U.S. PATENT DOCUMENTS 4,345,512 A * 8/1982 Moore ..... 99/323
5,172,837 A * 12/1992 Finney et al. ..... 223/23
5,556,013 A * 9/1996 Mayer ..... 223/84
5,829,083 A * 11/1998 Sutton ..... 8/150
5,971,236 A * 10/1999 DesForges et al. ..... 223/84
6,234,368 B1 * 5/2001 DesForges et al. ..... 223/84
6,742,683 B1 * 6/2004 Phan ..... 223/84
7,350,679 B2 * 4/2008 Radtke et al. ..... 223/84
2006/0162397 A1 * 7/2006 Ke ..... 68/235 R
2009/0185764 A1 * 7/2009 Hsieh ..... 383/86

* cited by examiner

*Primary Examiner* — Shaun R Hurley
*Assistant Examiner* — Andrew Sutton
(74) *Attorney, Agent, or Firm* — Cook Alex Ltd.

(57) ABSTRACT

A bra-washing device includes a shell and a divider removably insertable into the shell. The divider keeps one cup of the bra in one location of the shell and the other cup of the bra in another location of the shell. A system for washing garments includes a shell and two or more inserts each interchangeably coupleable to the shell. Each insert includes a three-dimensional form that is different from the three-dimensional form (s) of the other inserts. The openings in the shell may be sized to inhibit a bra strap from extending through the shell through the openings. A device may have buoyancy such that substantially all of the garment is maintained below the surface of water in a washing machine when the device and the garment are placed in the washing machine.

11 Claims, 9 Drawing Sheets

GARMENT WASHING DEVICE WITH REMOVABLE FORM

BACKGROUND OF THE INVENTION

1. Field of the Invention

The present invention generally relates to devices for washing clothes. In particular, embodiments relate to a washing device for brassieres and bikini tops.

2. Description of the Related Art

Brassieres are commonly made with two cups, two shoulder straps, two back straps, a latching mechanism (hooks and eyelets), optional padding (soft foam, air, water, gel, or silicone), and, optionally, two underwires. Padding can come as removable inserts or as an integral part of the bra. Some bras comprise extremely delicate fabric, such as lace, satin, silk, mesh, high-tech microfiber, stretch, and sheer fabric.

The underwires, when used in the cups, often become misshapen during washing and drying. Over time, the underwires frequently tear through the bra's fabric. This can result in injury to the breast or bra, and can also damage other clothing and the washing machine drum.

The latching mechanism, located either on the two back straps or on the front in between the cups at the intercup bridge, typically has several hooks and eyelets or a plastic snap closure. In the washing machine and/or dryer the hooks frequently snag onto the bra itself, zippers, buttonholes, sweaters, and delicate fabrics, as well as becoming misshapen. A bra can also easily become tangled with other clothing and in crevices within the washer and dryer, causing further deformities to the cups, padding, underwires, fabric, and straps. Repeated machine washing and drying can substantially diminish the elasticity of bras. The padding, especially if made of thick and soft foam, often becomes indented and bunched. If made of air, water, gel, or silicone, it can becomes punctured and leak. Such deformities are visible, even through a T-shirt, and are especially noticeable when tight fitting garments are worn. These problems are well understood by women who wear padded or non-padded bras.

Consequently, in an attempt to protect the bra's original shape, some users have tried to wash bras in a dishwasher. To do so, the bra must be fastened to the dishwasher to prevent it from shifting and becoming damaged by the dishwasher's pointed rack rods and rotating spray arm. Another way to wash bras is to place it within a mesh washing bag, which is then placed in a washing machine or dishwasher. However, because of its soft material construction, the bag still does not adequately prevent the bra from being damaged—such as losing its original shape, collapsing inward and against the cups' curved shape, and becoming tangled with other bras within the same bag. In addition, padded bras (especially those using air, water, gel, or silicone) can be easily punctured, thus causing leakage to the bra cups. The bra's hooks can also come loose and snag on other bras placed within the same bag. The time and money needed to replace a damaged bra can also be substantial.

Given all these inconveniences, many women have chosen to wash their bras by hand. However, hand washing is very time-consuming and impractical. It can also cause back, hand, and wrist pain. Most bras that are hand washed have to be air-dried, which causes huge water deposits where they are hung and thus slippery surfaces and more unnecessary cleanup.

Some devices are known for washing bras in washing machines. The density of the plastics used for many known devices is less than that of water. Because such devices tend to readily float, a substantial portion of such devices—as well as the garment in the device—may be above the surface of the wash water during washing.

SUMMARY

Various embodiments of garment-washing devices are disclosed. In an embodiment, a bra-washing device includes a shell and a divider that can be inserted into the shell. The divider keeps one cup of the bra in one location of the shell and the other cup of the bra in another location of the shell. The divider may be kept in a substantially fixed relationship with respect to the shell.

In an embodiment, a system for washing garments includes a shell and two or more inserts that can each be interchangeably coupled to the shell. Each insert includes a three-dimensional form that is different from the three-dimensional form (s) of the other inserts.

In an embodiment, a bra-washing device includes a shell and a form that couples to the shell. The shell and the form each have a plurality of openings. The openings in the shell are sized to inhibit a bra strap from extending through the shell through the openings. At least some of the openings in the form are larger than the openings in the shell.

In an embodiment, a device for washing a garment in a washing machine includes a shell and a form that can be coupled to the shell. The form holds at least a portion of the garment in a location in the shell. The device has a buoyancy such that substantially all of the garment is maintained below the surface of water in a washing machine when the device and the garment are placed in the washing machine.

BRIEF DESCRIPTION OF THE DRAWINGS

A better understanding of the present invention may be obtained when the following detailed description of preferred embodiments is considered in conjunction with the following drawings, in which.

Figure 1:
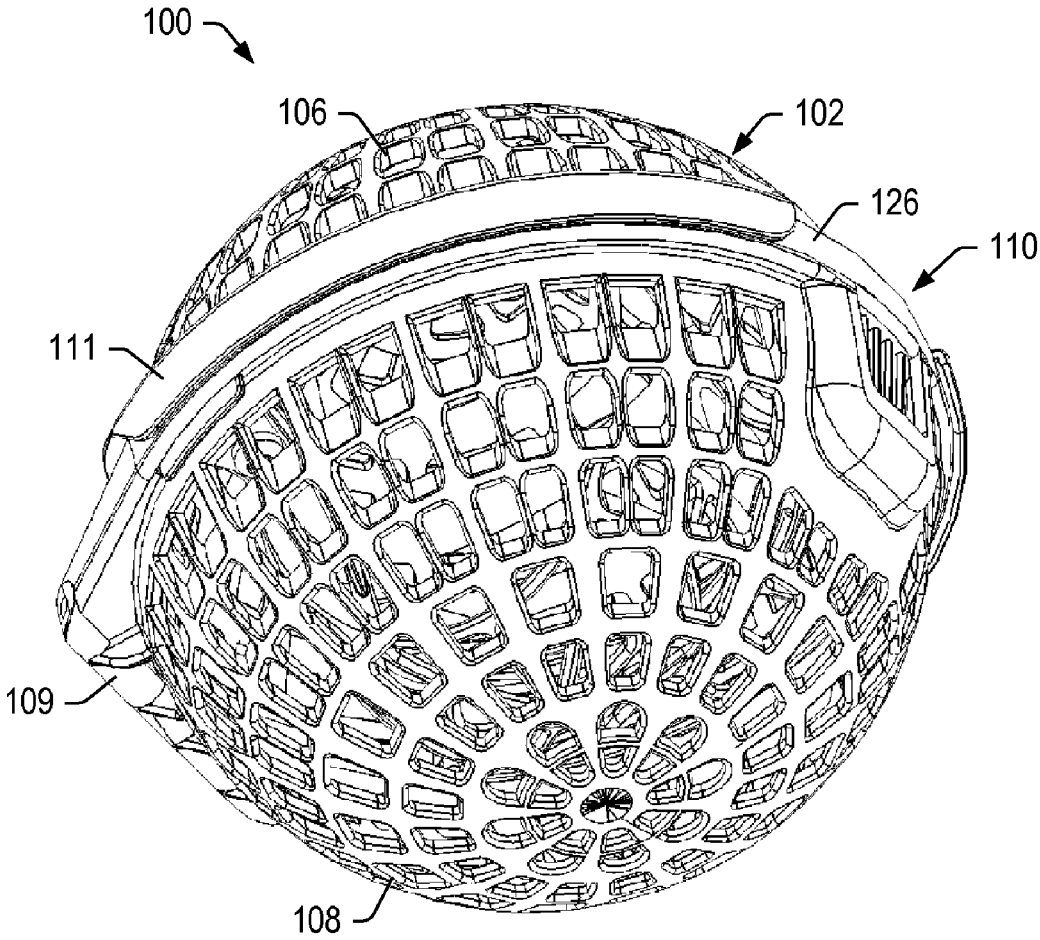
FIG. 1 is an external view of a washing device according to one embodiment.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended requests. Note, the headings are for organizational purposes only and are not meant to be used to limit or interpret the description or claims. Furthermore, note that the word "may" is used throughout this application in a permissive sense (i.e., having the potential to, being able to), not a mandatory sense (i.e., must). The term "include", and derivations thereof, mean "including, but not limited to". The term "coupled" means directly or indirectly coupled.

DETAILED DESCRIPTION OF ILLUSTRATIVE EMBODIMENTS

Figure 2A:
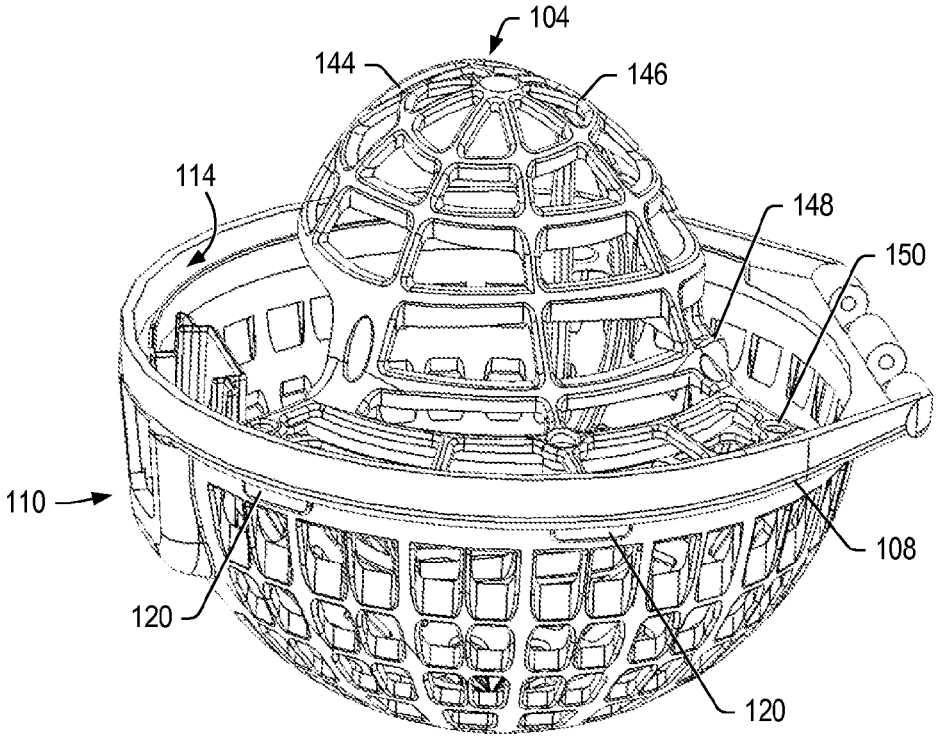
FIG. 2A illustrates a washing device with an insert according to one embodiment.
Figure 2B:
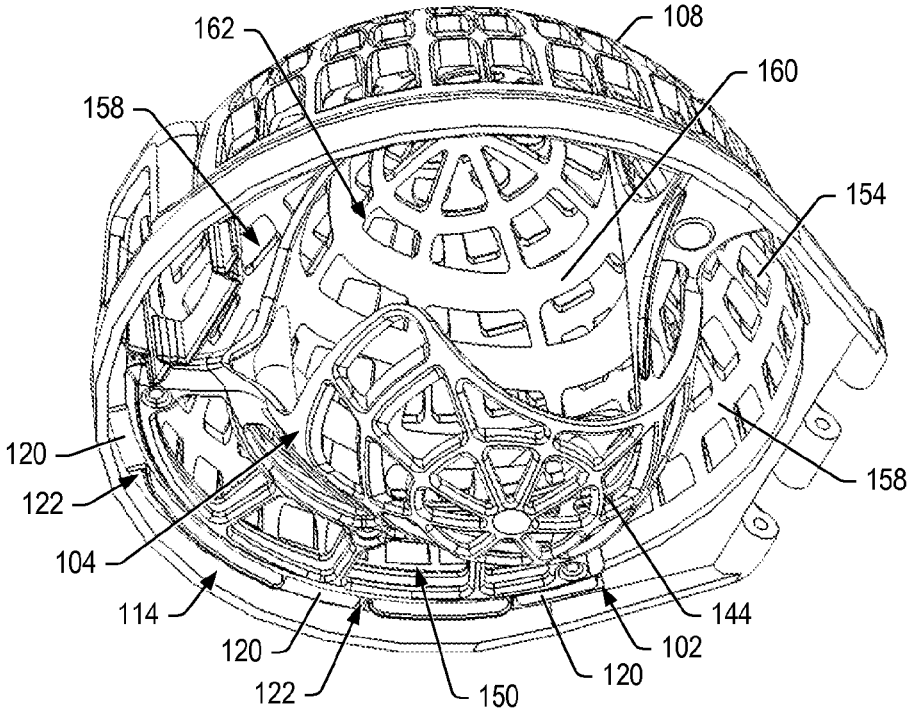
FIG. 2B is a different view of the washing device illustrated in FIG. 2A.

FIGS. 1, 2A, and 2B illustrate a washing device according to one embodiment. Washing device 100 includes shell 102 and insert 104. Shell 102 includes upper shell half 106 and lower shell half 108. Upper shell half 106 and lower shell half 108 may be pivotally connected at hinge 109. Shell 102 may be opened by swinging upper shell half 106 away from lower shell half 108. Insert 104 may be removed from shell 102 when shell 102 is open. Shell 102 includes latch mechanism 110. Latch mechanism 110 may hold shell 102 in a closed position.

Device 100 may protect a garment from damage caused by the washer, dryer, or other clothing articles. Device 100 may protect bra underwires from becoming bent or protruding from the bra and thus piercing its fabric. In one embodiment, shell 102 and insert 104 are made out of polypropylene that is heat graded to protect it from heat damage.

Figure 1A:
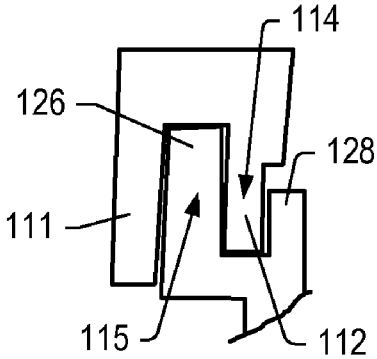
FIG. 1A is a cross sectional view of a junction between two halves of a shell of a washing device according to one embodiment.

As shown in FIGS. 1 and 1A, shell upper half 106 includes channel 115 between outer rim 111 and inner rim 112. Shell lower half 108 includes channel 114 between inner rim 128 and outer rim 126. Inner rim 112 of upper shell half 106 may nestle in channel 114 of lower shell half 108 when shell 102 is closed. Outer rim 126 of lower shell half 108 may nestle in channel 115 of upper shell half 106 when shell 102 is closed. Engagement of inner rim 112 in channel 114 and/or rim 126 in channel 115 may inhibit lateral movement of upper shell half 106 relative to lower shell half 108. Engagement of inner rim 112 in channel 114 and/or outer rim 126 in channel 115 may also inhibit deformation of the shell halves (e.g., flexure, buckling) near the junction of the upper shell half and the lower shell half. Inhibiting deformation may keep upper shell half 106 and lower shell half 108 from separating when external loads are encountered during washing and/or handling of device 100. Engagement of inner rim 112 in channel 114 and/or outer rim 126 in channel 115 may also alleviate stress on latch mechanism 110 and hinge 109.

Referring to FIGS. 2A and 2B, insert 104 includes tabs 120 (upper shell half 106 is not shown in FIG. 2A or 2B for clarity). Lower shell half 108 includes slots 122. Insert 104 may be coupled with lower shell half 108 by inserting each of tabs 120 on insert 104 in a corresponding slot 122 on lower shell half 108. Tabs 120 of insert 104 and slots 122 of lower shell half 108 may be distributed at various points along the circumference of lower shell half 108. At least one tab on an insert may be partially (as shown in FIG. 2A) or fully opposed to one or more other tabs on the insert.

Figure 3:
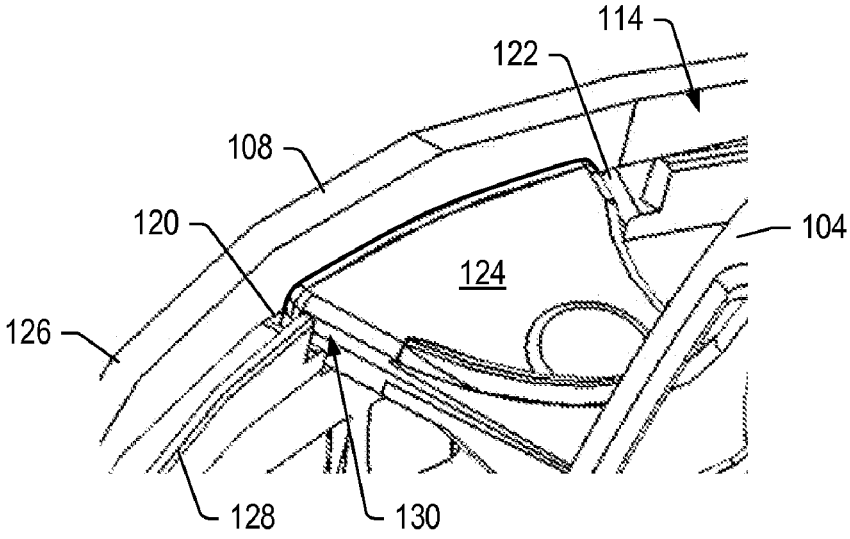
FIG. 3 is a detail view of a tab-slot connection between an insert and a shell of a washing device.

FIG. 3 is a detail view of one tab-slot connection between insert 104 and shell 102. Insert 104 includes arm 124. Lower shell half 108 includes outer rim 126 and inner rim 128. Outer rim 126 and inner rim 128 define channel 114 in lower shell half 108. Lower shell half 108 includes slot 122 at the bottom of channel 114. Arm 124 includes tab 120. Tab 120 may be inserted in slot 122 on lower shell half 108. Arm 124 may come to rest within break 130 in inner rim 128. When shell 102 is closed, inner rim 112 of upper shell half 106 (shown in FIG. 1) may hold arm 124 in place on lower shell half 106. In an similar manner, inner rim 112 of upper shell half 106 may hold other tabs 120 of insert 104 in place in slots 122 of lower shell half 108. Thus, closure of shell 102 may keep insert 104 in a relatively fixed position relative to shell 102.

In some embodiments, an insert may be coupled to a shell without tabs or slots. An insert may include pins, flanges, arms, or beams that connect to one half or both halves of a shell. For example, an insert may include a pin or pins that plug into holes in one shell half In certain embodiments, an insert, form or divider may be permanently or semi-permanently attached to an outer shell. An inner form connected by a hinge to an outer shell is shown, for example, in U.S. Pat. No. 6,742,683 to Phan.

Figure 4:
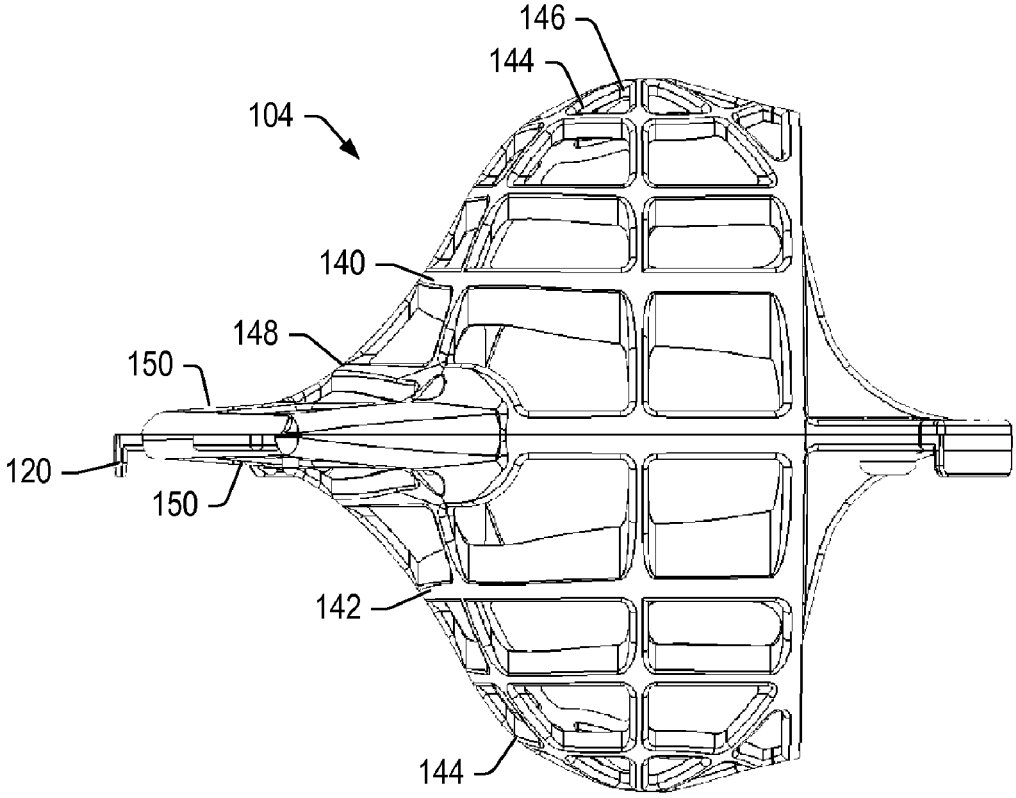
FIG. 4 is a side view of an insert for a padded bra according to one embodiment.

FIG. 4 illustrates insert 104 when separated from shell 102. Insert 104 includes upper insert half 140 and lower insert half 142. Each insert half includes form 144. Each of forms 144 may provide a contoured surface to hold a cup of a bra. Forms 144 may have a contour similar to the inner sides of the breast cup sides they are to be used with. Forms 144 may help preserve the curvature of underwires and bra cups. Forms 144 of upper insert half 140 and lower insert half 142 may be mirror images of one another, or they may be different. Forms 144 may include rounded portion 146, curved portion 148, and flat portion 150. Curved portion 148 may be in the form of a fillet that provides a smooth transition between rounded portion 146 and flat portion 150. The shape of curved portion 148 (e.g., concave) may allow for space to accommodate padding of a padded bra cup. Forms may have various shapes, such as spherical, s-shaped, slanted, flat, ovate, or irregular. Forms may be integral to an insert, or they may be a separate element (e.g., attached to an insert base).

When installed in shell 102, insert 104 may serve to divide internal volume 154 of shell 102 into two halves. Referring to FIG. 2B, passages 158 extend between the two halves. Insert 104 includes pocket 160. Pocket 160 includes opening 162. Pocket 160 may house one or more bra straps (e.g., when a bra cup of the bra is placed on each of forms 144). Pocket 160 can also house delicate accessories, such as removable bra straps, demi-pads, pushup pads, shoulder pads, hosiery, panties, and scarves. Passages 158 may accommodate an intercup bridge of a bra. In one embodiment, passages may accommodate up to three bra intercup bridges, depending upon the thickness of the bra's cups.

In one embodiment, shell 102 has sufficient space to accommodate one thickly-padded bra, or two stacked semi-padded bras, or three stacked non-padded bras. When more than one bra is placed inside the protector, they may be stacked so that the front sides of the cups of the second bra faces the breast sides of the cups of the first bra, etc.

In an embodiment, a system for washing garments includes a shell and two or more inserts. Each insert may be interchangeably installed in the shell. The inserts may have different shapes. Each of the shapes may accommodate a different type or shape of garment. For example, one insert may have a form suitable for washing a padded bra and another insert may have a form suitable for washing unpadded bras. A user of the device may select the appropriate insert or inserts for the garment or garments the user desires to wash, dry, or store.

Figure 5:
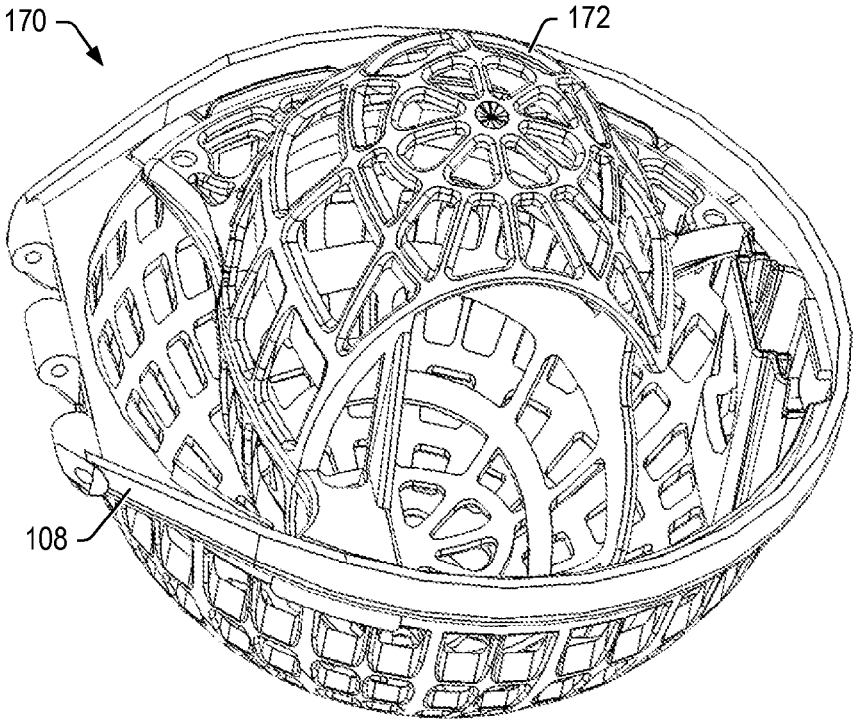
FIG. 5 illustrates a device suitable for washing an unpadded bra according to one embodiment.

FIG. 5 illustrates a washing device for an unpadded bra according to one embodiment. Device 170 includes insert 172. The shell of the device shown in FIG. 5 may be the same as that described above with respect to FIGS. 1, 2A, and 2B (for clarity, only lower shell half 108 is shown in FIG. 5). Insert 172 may couple with lower shell half 108 in the same manner as insert 104 (shown, for example, in FIGS. 2A and 3).

Figure 6:
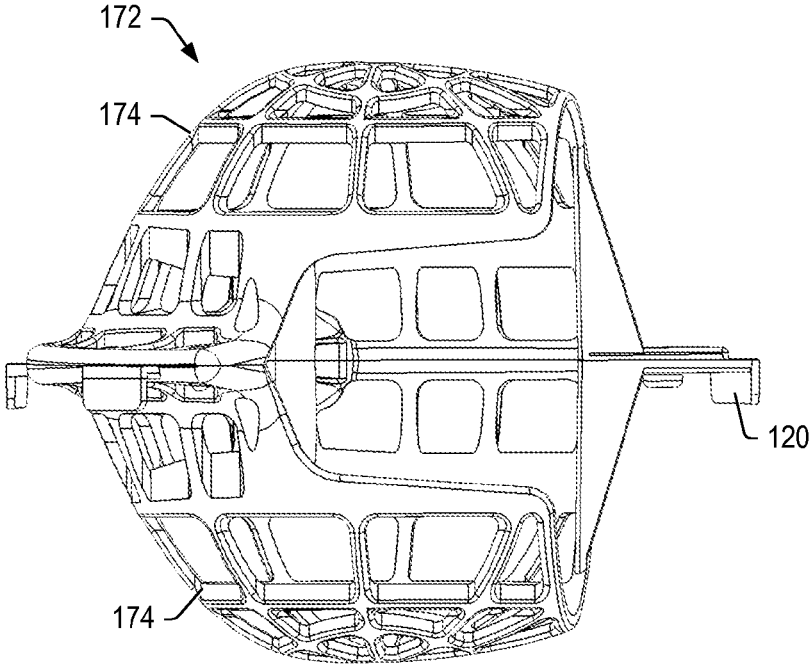
FIG. 6 is a side view of an insert suitable for washing an unpadded bra according to one embodiment.

FIG. 6 is a side view that illustrates insert 172 when not installed in shell 102. Insert 172 includes forms 174. Forms 174 may have more fully rounded shape than that of forms 144 of insert 104. More rounded forms may be better suited for holding a bra cup of an unpadded bra.

Figure 7:
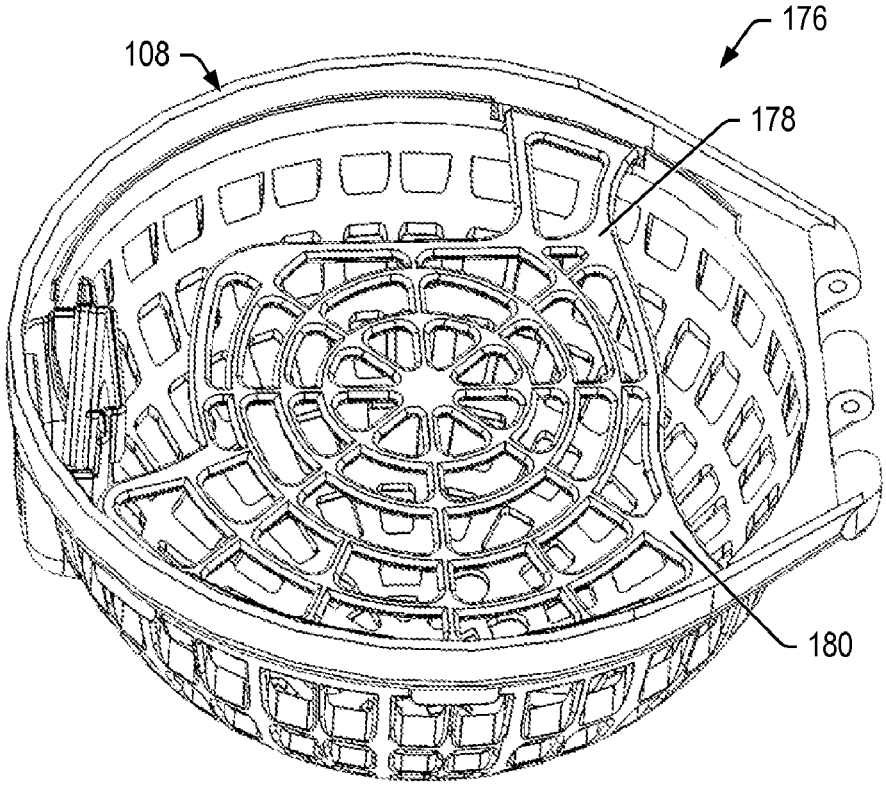
FIG. 7 illustrates a device suitable for washing a bra having a prosthesis according to one embodiment.

In some embodiments, a washing device may include a form suitable for washing a garment that holds one or prosthetic devices (e.g., a post-mastectomy bra). FIG. 7 illustrates a washing device for a bra having a prosthetic device according to one embodiment. Device 176 includes insert 178. The shell of the device shown in FIG. 7 may be the same as that described above with respect to FIGS. 1, 2A, and 2B (for clarity, only lower shell half 108 is shown in FIG. 7). Insert 178 may couple with lower shell half 108 in the same manner as insert 104.

Figure 8:
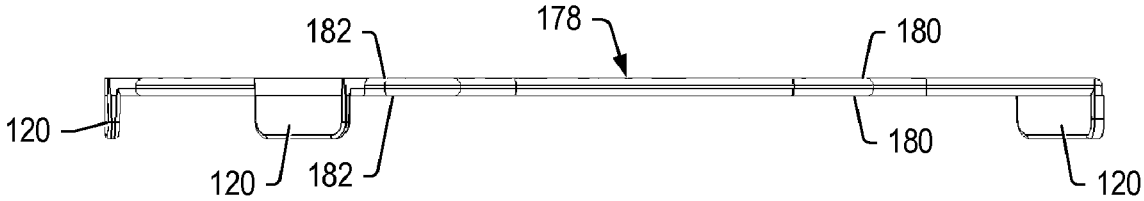
FIG. 8 is a side view of an insert suitable for washing a bra having a prosthesis according to one embodiment.

FIG. 8 is a side view that illustrates insert 178 when not installed in shell 102. Insert 178 includes forms 180. Forms 180 may include flat surfaces 182. Flat surfaces may accommodate a bra cup that carries a breast prosthesis. Forms for garment carrying a prosthesis may also be a convex, concave, or other suitable shape. In one embodiment, a form for a garment carrying a prosthesis is customized for the garment. Washing devices (e.g., device 176) can also be used for washing, drying, or storing removable bra straps, demi-pads, pushup pads, shoulder pads, hosiery, panties, scarves and small clothing articles. Alternatively, such items may be washed in shell 102 without any insert.

In some embodiments, the opposing sides of an insert may have different shapes. For example, an insert may include a rounded surface on one side (e.g., for an unpadded bra cup) and a flat surface on the other side (e.g., for a bra cup with a breast prosthesis).

Because inserts 104, 172, and 178 can each be inserted into a same shell (e.g., shell 102), a common shell can be used for washing different types of bras. Although only three inserts are shown in FIGS. 2A-8, a system may include less than three different inserts or more than three different inserts. Inserts may be provided for garments other than bras. For example, inserts may be provided for items such as hats, gloves, scarves, hosiery, or slippers.

Insert 104, upper shell half 106, and lower shell half 108 may be foraminous, e.g., they may have numerous holes. These holes may allow water, detergent, and air to freely penetrate to a bra inside (not shown) for thorough cleaning, drying, and storage. The numerous holes may allow detergent, water, and air to freely and thoroughly penetrate and flow between the bras when a garment or garments (e.g., two semi-padded or three non-padded bras are washed in the device. In one embodiment, the diameter of each hole is about one cm. In one embodiment, the holes are between about 0.5 cm and about 1.0 cm. The holes may be smaller than the bra's shoulder straps, which will prevent the straps from falling out of the holes. Small holes may also prevent bra's back straps and shoulder straps from losing elasticity and the hooks on the bra's back strap from catching onto other clothing articles, zippers, buttonholes, the washer and dryer's crevices, as well as the bra itself. In one embodiment, shell 102 has a diameter of about 12 to about 16 cm with each half having about 60 to 80 holes (depending upon the device's size, which is determined by the bra's cup size). Insert 104 may have about 40 to 70 holes. In some embodiments, a flange, web or other portion of an insert connecting a form may include openings. For example, as shown in FIG. 2A, insert 104 includes holes in the area of flat portion 150.

Figure 9:
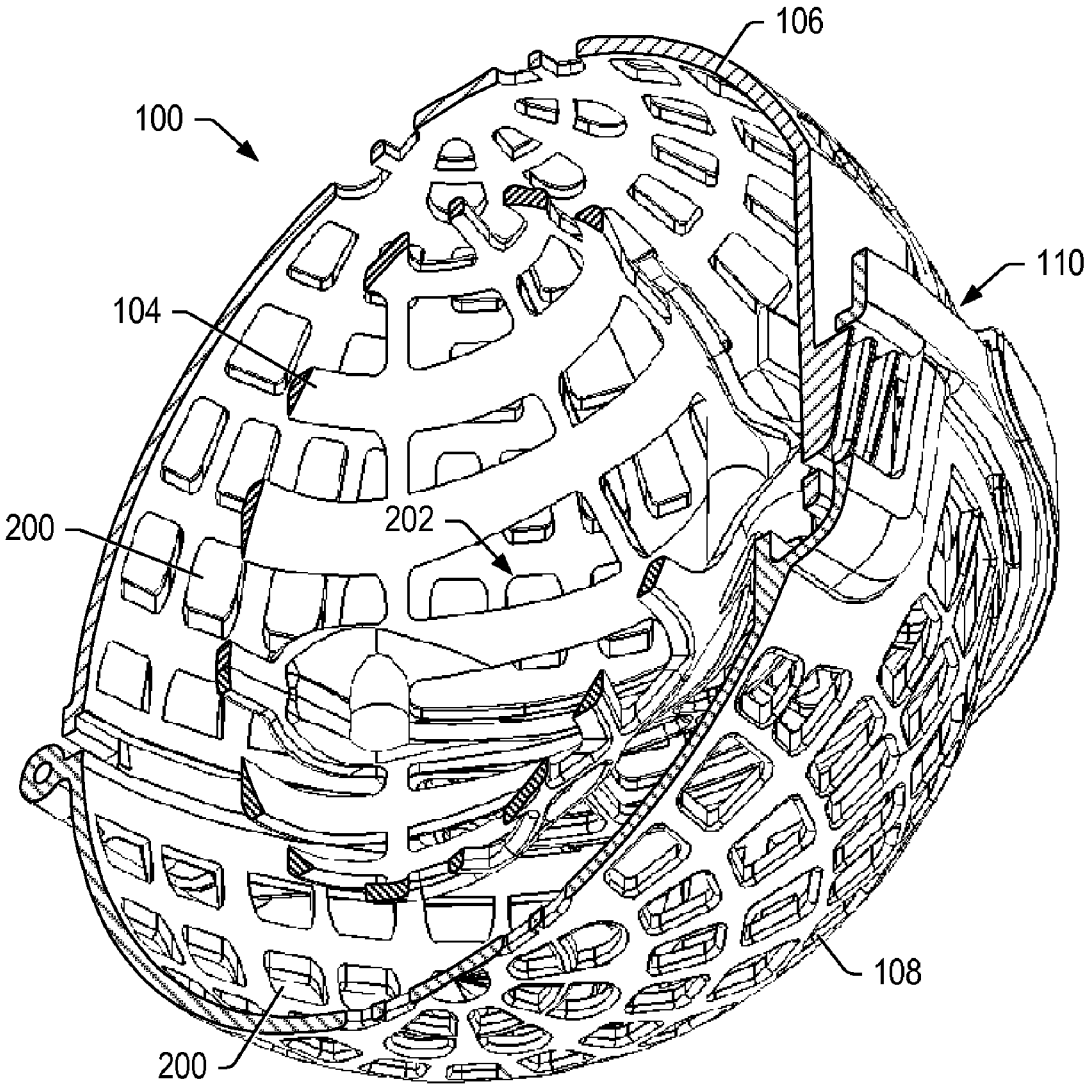
FIG. 9 is a cross-sectional view of a washing device with a shell and an insert according to one embodiment.

FIG. 9 illustrates a cross sectional view of a washing device according to one embodiment. Upper shell half 106 and lower shell half 108 include shell openings 200. Insert 104 includes insert openings 202. In some embodiments, shell openings 202 are sized and shaped to inhibit the bra strap or portions thereof from extending outside of the shell. Holes may be large enough for water, detergent, and air to penetrate, but small enough to contain bra shoulder strap, back strap, and hooks, thus preventing them from becoming tangled with other clothing articles and the washer and dryer's crevices. Insert openings 202 may be larger than shell openings 200. Relatively large insert openings 202 may allow for better flow through the insert, thereby increasing cleaning effectiveness. Apertures (such as openings 200 or openings 202) in a washing device may be various shapes, including round, rectangular, square, trapezoidal, hexagonal, triangular, ovate, or irregular.

Figure 10:
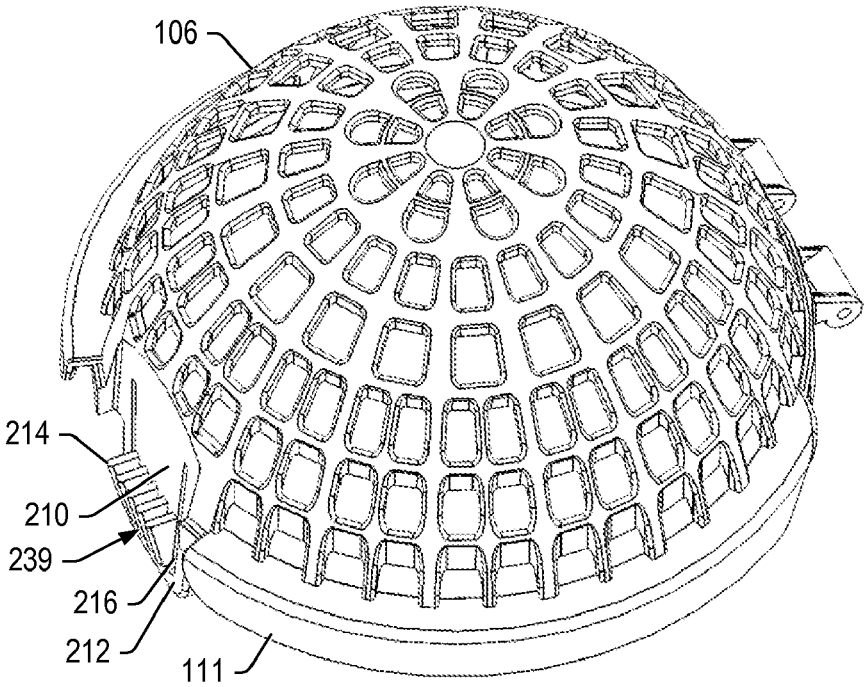
FIG. 10 illustrates an upper shell half of a device including a latch mechanism according to one embodiment.

FIGS. 10-13 illustrate latch mechanism 110. Referring to FIG. 10, upper shell half 106 includes tongue 210 and loop 212. Tongue 210 includes latch projections 214. Tongue 210 may resiliently deflect when a load is applied to latch projections 214 toward the interior of upper shell half 106. U-shaped slot 216 may extend through the entire thickness of upper shell half 106, thereby creating a U-shaped gap between tongue 210 and loop 212.

Figure 11:
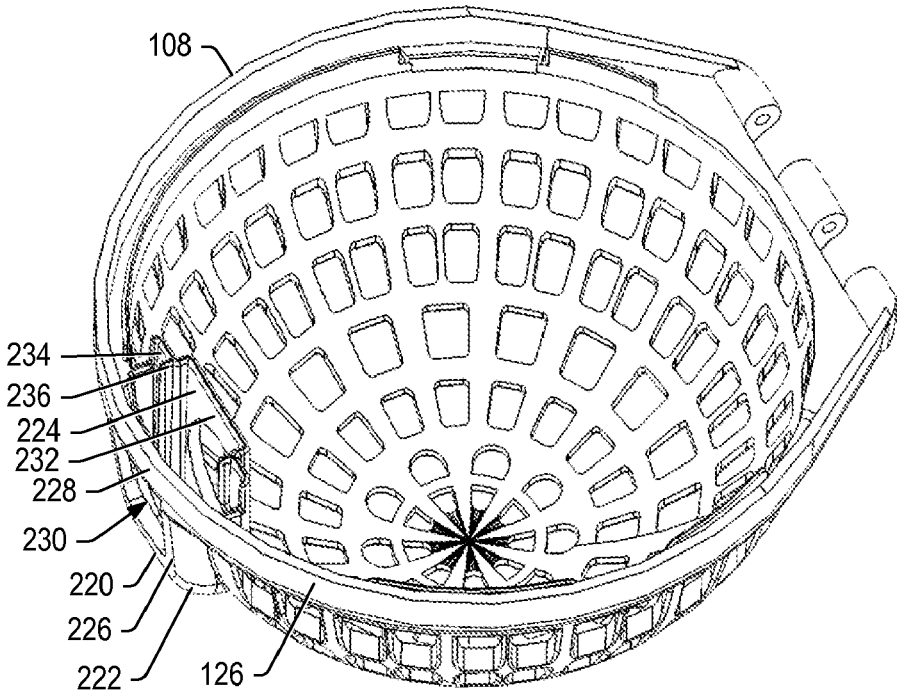
FIG. 11 illustrates a lower shell half of a device including a latch mechanism according to one embodiment.

Referring to FIG. 11, lower shell half 108 includes receptacle 220. Receptacle 220 includes exterior portion 222 and interior portion 224. Exterior portion 222 includes raised front wall surface 226, catch 228, and finger opening 230. Interior portion 224 includes back wall 232, sides 234, and rails 236. Raised front wall surface 226 and catch 228 may shield tongue 210 from normal wear and tear. In addition, having tongue 210 recessed may help keep device 100 from being accidentally opening during washing, drying, and storage.

Figure 12:
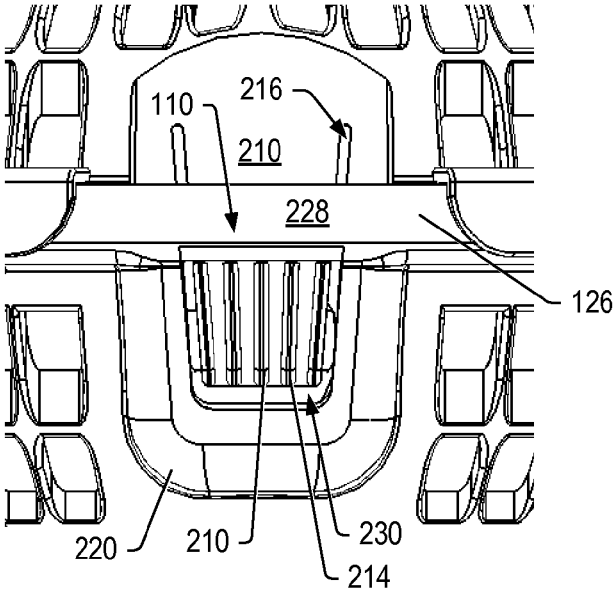
FIG. 12 illustrates a latch mechanism for a washing device according to one embodiment.
Figure 13:
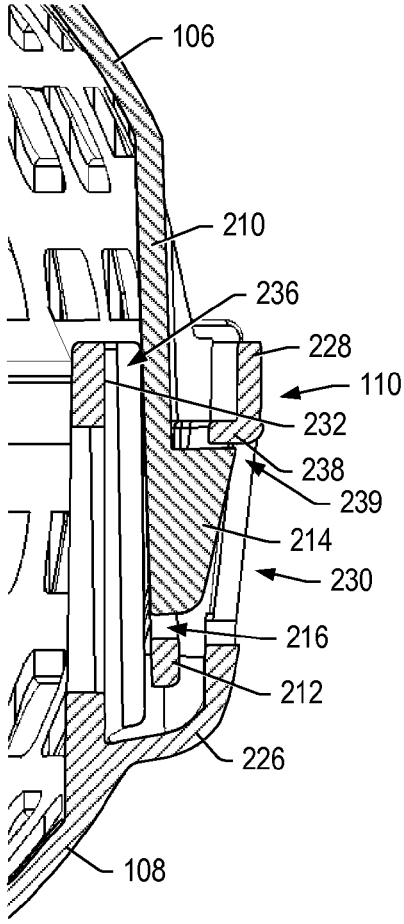
FIG. 13 is a cross section view of a latch mechanism for a washing device according to one embodiment.

FIG. 12 illustrates latch 110 in a latched position. FIG. 13 illustrates a cross-sectional view of latch 110 in a latched position. As shown in FIG. 13, catch 228 includes catch tab 238. During operation of latch mechanism 110, tongue 210 and loop 212 are received in receptacle 220. Latch projections 214 slide over catch tab 238. The distal portion of tongue 210 deflects inwardly as tongue 210 and loop 212 advance into receptacle 220. When latch projections 214 slide beyond catch tab 238, tongue 210 may spring back outwardly such that latch projections 214 extend into finger opening 230. Tongue 210 may snap into a latched position. Contact between latch projections 214 and catch 228 inhibit shell 102 from opening.

To open shell 102, a user may engage the upper edge of outer rim 126 with one or more fingers and depress tongue 210 with the thumb of the same hand. The user may push inwardly on latch projections 214 of tongue 210 through finger opening 230 until tongue 210 bottoms out on back wall 232. When tongue 210 bottoms out on back wall 232, a portion of latch projections 214 (e.g., tips 239) may come just short of clearing catch tab 238. The user may exert an upward force on tongue 210 so as to overcome the resistance of latch projections 214 against catch tab 238 and force latch projections 214 upward past catch tab 238. The inner end of catch tab 238 and/or back wall 232 may deflect at least slightly under the upward force of latch projections 214 so as to allow latch projections 214 to pass catch tab 238. Thus, a user releases latch mechanism 110 by simultaneously applying force in two directions (e.g., a force inward on tongue 210 against the resilient force of the tongue, and a force upward on tongue 210 against the resistance of catch tab 238). A latch mechanism that opens by the application of a force in two directions may be less prone to accidental opening during use in a washing machine. For example, in the embodiment described above, even if latch projections 214 directly strike a pointed surface (e.g., part of the agitator of the washing machine) when the device is agitated within the washing machine (thereby applying an inward force to tongue 210), latch mechanism 110 may remain latched because there is no upward force to impel latch projections 214 over catch tab 238.

As noted above with respect to FIG. 11, interior portion 224 of receptacle 220 includes rails 236. Loop 212 on upper shell half 106 may contact rails 236 when tongue 210 and loop 212 are inserted into receptacle 220. Contact between loop 212 and rails 236 may inhibit the upper portion of tongue 210 from deflecting inwardly. In some embodiments, contact between loop 212 and rails 236 may inhibit latch mechanism 110 from opening accidentally during washing.

In certain embodiments, a tongue may be relatively short such that a relatively large force is required to deflect the end of the tongue. For example, in one embodiment, slots of loop 216 (shown in FIG. 12) do not extend above the top of inner rim 112 (i.e., would not be visible in FIG. 12) when shell 102 is closed.

Figure 14:
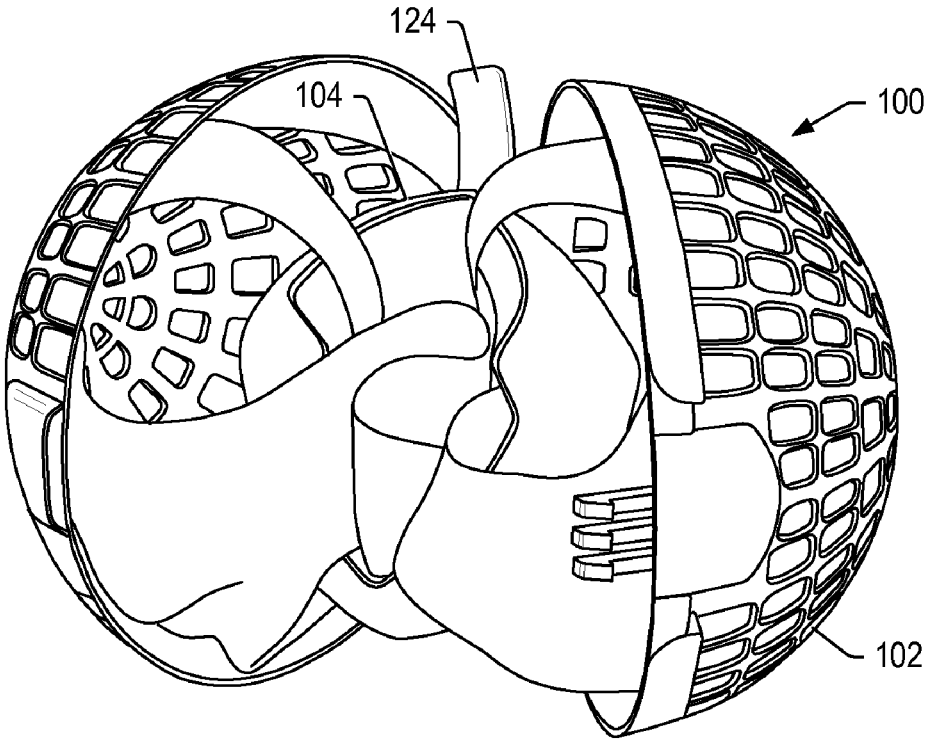
FIG. 14 illustrates a partially exploded view of a washing device with a bra according to one embodiment.

FIG. 14 illustrates placement of a bra in a washing device according to one embodiment. As noted above, insert 104 can be removed from shell 102. When insert 104 is removed, one or more bras can be stacked inside the shell. When washing, drying, or storing one bra in the device, the bra may be placed with its bra cup's front sides facing the interior surfaces of shell 102. If a second bra is placed into the device, the second bra's front sides face the first bra's breast sides. In certain embodiments, a third bra may be placed within the device. The third bra's cup front sides face the second bra's breast sides. After all bras are positioned in shell 102, insert 104 may be installed on lower shell half 108. Shoulder straps and back straps of both the first and second bras are tucked into pocket 160. Shell 102 may be closed. In an alternate method, a garment may first be arranged on or in an insert, and then the insert installed (with garment) into the shell.

Multiple bras can be thoroughly cleaned, dried, and stored. When two semi-padded or three non-padded bras are simultaneously washed in the device, holes may allow detergent, water, and air to freely penetrate and flow between the bras to thoroughly wash and dry as well as safely store each bra, including a middle placed bra when three bras are concurrently washed.

In some embodiments, the buoyancy of a device is selected so that the garment being washed remains completely or mostly below the surface of the washing water during use. Buoyancy may be controlled by factors such as material density, shell dimensions, and opening dimensions. Buoyancy may be selected such that the device tends to not sink to the bottom of the water. In certain embodiments, the buoyancy may be such that device does not sink to rest on a clothes that have piled up on the bottom surface of the washing machine. In one embodiment, the combined buoyancy of the washing device and the garment to be washed is about zero. A device with a buoyancy of about zero may remain fully or mostly submerged while not getting embedded with clothes piled in the washing machine.

Figure 15:
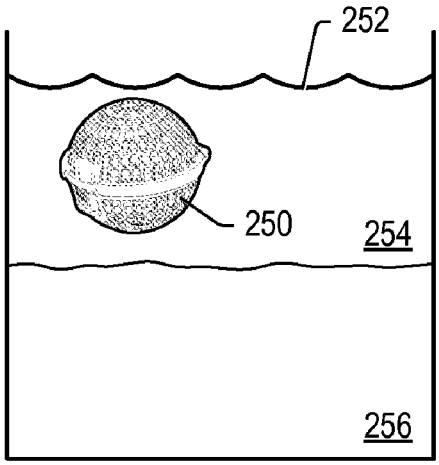
FIG. 15 illustrates a washing device that is fully submerged during use according to one embodiment.
Figure 16:
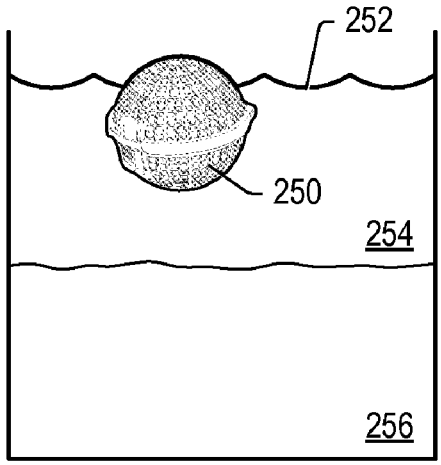
FIG. 16 illustrates a washing device that is partially submerged during use according to one embodiment.

FIG. 15 and FIG. 16 illustrate garment washing devices a washing machine. In FIG. 15, the garment-washing device 250 remains submerged below surface 252 of washing water 254. Garment-washing device 250 remains above clothes 256. In FIG. 16, a portion of the garment-washing device 250 is above surface 252 of washing water 254, but most of garment-washing device 250 remains below the surface.

Use of materials of relatively low density such polypropylene may result in a device that tends to float on the surface of the water. In some embodiments, the number and size of holes in a bra washing device are selected to produce a desired combined buoyancy of a device and a garment being washed. For example, the combined buoyancy of a given device and garment may be reduced by increasing the sizes of holes in a shell and/or insert of the device.

As used herein, "buoyancy" refers to the tendency of something to float or rise when submerged in a fluid. An object with positive buoyancy tends to float up to the surface. An object with negative buoyancy tends to sink. And object that has neutral buoyancy tends to stay where it is.

As used herein, to "float" means to not sink to the bottom.

As used herein, "shell" includes any element that at least partially encloses, houses, or covers one or more other objects. Examples of such objects include garments, dividers, forms, inserts, and accessories. A shell can be any of various shapes, including spherical, cubic, egg-shaped, rectangular, clam-shaped or irregular. A shell can have one part or more than one part. For example, a shell may have two halves that are connected by a hinge. A shell may have closed or open surfaces (e.g., surfaces having openings).

As used herein, "location" refers to a location of something in space. A location may be a three-dimensional area, zone, or region. For example, a location may be the internal volume on one side of a shell of a bra-washing device. The volume may be bounded, for example, by the inner surfaces of a shell. As used herein, "in a location" includes a specific location (e.g., in direct contact with an insert) or a general location (e.g., anywhere within a desired half of the volume of a spherical shell).

As used herein, "divider" includes any element that at least partially divides a volume into two or more portions. For example, a divider may divide the inner volume of a shell into two equal hemispheres. A divider may divide a space into equal portions or unequal portions.

As used herein, "garment-washing water" means a solution or mixture that includes water and soap, detergent, or other composition(s) for cleaning garments.

Further modifications and alternative embodiments of various aspects of the invention may be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims. Terms relating to orientation, such as "upper", "lower", "top", "bottom", "left", or "right", are used for reference only; the device herein may be used in any orientation.

What is claimed is:

1. A bra-washing device, comprising:

a shell;

a divider removably insertable into the shell;

the shell includes two shell portions;

the shell portions are pivotally coupled to one another;

a rim of one of the shell portions includes a lip, a rim of the other shell portion includes a channel, the lip on one of the shell portions couples into the channel in the other shell portion when the shell is closed;

at least a portion of the divider is kept in a substantially fixed relationship to the shell when the divider is inserted into the shell, the divider is configured to keep one cup of the bra in one location of the shell and the other cup of the bra in another location of the shell;

the divider is contained within the shell portions when the shell is closed; and a latch mechanism configured to hold shell closed, the latch mechanism including a tongue and a loop on one portion of the shell; and a receptacle on the other portion of the shell, the receptacle configured to receive the tongue and the loop, wherein the receptacle comprises a rail configured to contact the loop, wherein contact between the loop and rail inhibits the latch mechanism from opening accidentally during washing.

2. The bra-washing device of claim 1, further comprising a plurality of apertures disposed in said shell, said plurality of apertures sized to inhibit a bra strap from extending through the shell.

3. The bra-washing device of claim 1, wherein the divider couples to the shell in a tab and slot arrangement.

4. The bra-washing device of claim 1, wherein the divider comprises at least one form for at least a portion of a bra cup.

5. The bra-washing device of claim 4, wherein the form comprises a rounded portion and rim projecting from the rounded portion.

6. The bra-washing device of claim 4, wherein at least a portion of the form is substantially spherical.

7. The bra-washing device of claim 4, wherein at least a portion of the form is substantially fiat.

8. The bra-washing device of claim 1, wherein the divider comprises a pocket configured to receive at least one bra strap.

9. The bra-washing device of claim 1, wherein the divider is configured to divide the shell into two spatial regions, wherein the divider comprises a passage connecting the two spatial regions.

10. The bra-washing device of claim 1, wherein the latch is operated by simultaneously applying a force in an inward direction and a force in an upward direction.

11. A bra-washing device, comprising:

a shell;

a divider removably insertable into the shell;

the shell includes two shell portions;

the shell portions are pivotally coupled to one another;

a rim of one of the shell portions includes a lip, a rim of the other shell portion includes a channel, the lip on one of the shell portions couples into the channel in the other shell portion when the shell is closed;

at least a portion of the divider is kept in a substantially fixed relationship to the shell when the divider is inserted into the shell, the divider is configured to keep one cup of the bra in one location of the shell and the other cup of the bra in another location of the shell;

the divider is contained within the shell portions when the shell is closed; and a latch mechanism configured to hold shell closed, the latch mechanism comprising a resilient member on one shell portion, wherein the resilient member is between a pair of slots, wherein the slots do not overlap with the other shell portion when the latch is closed.

* * * * *